US010366682B2

(12) United States Patent
Letcher

(10) Patent No.: US 10,366,682 B2
(45) Date of Patent: Jul. 30, 2019

(54) POSITIONING APPARATUS FOR STRINGED MUSICAL INSTRUMENTS

(71) Applicant: Ryan Letcher, Endicott, NY (US)

(72) Inventor: Ryan Letcher, Endicott, NY (US)

(73) Assignee: Ryan Letcher, Endicott, NY (US)

( * ) Notice: Subject to any disclaimer, the term of this patent is extended or adjusted under 35 U.S.C. 154(b) by 0 days.

(21) Appl. No.: 15/939,963

(22) Filed: Mar. 29, 2018

(65) Prior Publication Data

US 2018/0286364 A1 Oct. 4, 2018

Related U.S. Application Data

(60) Provisional application No. 62/478,351, filed on Mar. 29, 2017.

(51) Int. Cl.
*G10G 5/00* (2006.01)
*G10D 1/08* (2006.01)

(52) U.S. Cl.
CPC ..... *G10G 5/005* (2013.01); *G10D 1/08* (2013.01)

(58) Field of Classification Search
CPC ..... G10G 5/005; G10D 1/08
See application file for complete search history.

(56) References Cited

U.S. PATENT DOCUMENTS 7,906,717 B2 * 3/2011 Wang ..... G10G 5/00 248/121

* cited by examiner

*Primary Examiner* — Kimberly R Lockett
(74) *Attorney, Agent, or Firm* — Wenderoth, Lind & Ponack, L.L.P.

(57) ABSTRACT

A novel stringed musical instrument positioning apparatus including a rear plate, and at least one stabilizer bar which attach to an elevator platform and adjust to accommodate various sizes of stringed musical instruments so that they may be played from different angles from which they were originally intended.

8 Claims, 10 Drawing Sheets

POSITIONING APPARATUS FOR STRINGED MUSICAL INSTRUMENTS

FIELD OF THE INVENTION

The present invention relates to novel devices and apparatuses for positioning stringed musical instruments. More particularly, the invention relates to a novel apparatus comprised of various components that is capable of allowing various stringed musical instruments to be played from different angles than originally intended.

BACKGROUND

Stringed musical instruments can potentially produce different varieties of sound depending upon the angle at which they are played. Additionally, stringed musical instruments can potentially produce different varieties of sound depending upon the object, and the angle of application of the object, applied to their strings. The angular orientation of a stringed musical instrument can potentially limit the application of different objects to its strings.

Historically, upright stringed musical instruments have been a separate purchase from horizontal stringed musical instruments and only for specific purposes. While electric versions of upright instruments have been developed, quality upright stringed musical instruments can be cost-prohibitive for many musicians who already possess quality non-upright instruments (e.g.: guitars).

Therefore, a need exists in the field for novel devices and apparatuses for the purpose of allowing various stringed musical instruments, such as non-upright stringed instruments, to be played from different angles than originally intended, such as in an upright playing position.

BRIEF SUMMARY OF THE INVENTION

The present invention comprises a novel apparatus generally comprised of an adjustable elevated frame, which is generally comprised of adjustable components to secure a stringed musical instrument to be played at a desired angle.

Disclosed herein are details of an apparatus to be connected to a stringed instrument for positioning the stringed instrument to an upright playing position, the apparatus comprising: a rear plate, to be positioned behind the instrument; a first stabilizer bar connected to the rear plate and to be positioned in front of the instrument; a second stabilizer bar connected to the rear plate and to be positioned in front of the instrument; an elevator platform connected to the rear plate and to be positioned below the instrument; and a leg connected to the rear plate, wherein the rear plate, first stabilizer bar, second stabilizer bar, and elevator platform grip the instrument such that the rear plate, first stabilizer bar, second stabilizer bar, elevator platform, and instrument can together be held upright on the leg.

Further, the rear plate includes a first adjustment slot, and a second adjustment slot; the elevator plate is connected to the rear plate via a first bolt through the first adjustment slot and a second bolt through the second adjustment slot; the first stabilizer bar includes an adjustment slot and is connected to the rear plate via a third bolt through the adjustment slot in the first stabilizer bar; and the elevator plate, the first stabilizer bar, and the second stabilizer bar are together movable relative to the rear plate via the first and second adjustment slots in the rear plate and the adjustment slot in the first stabilizer bar.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION AND BEST MODE OF IMPLEMENTATION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art of which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
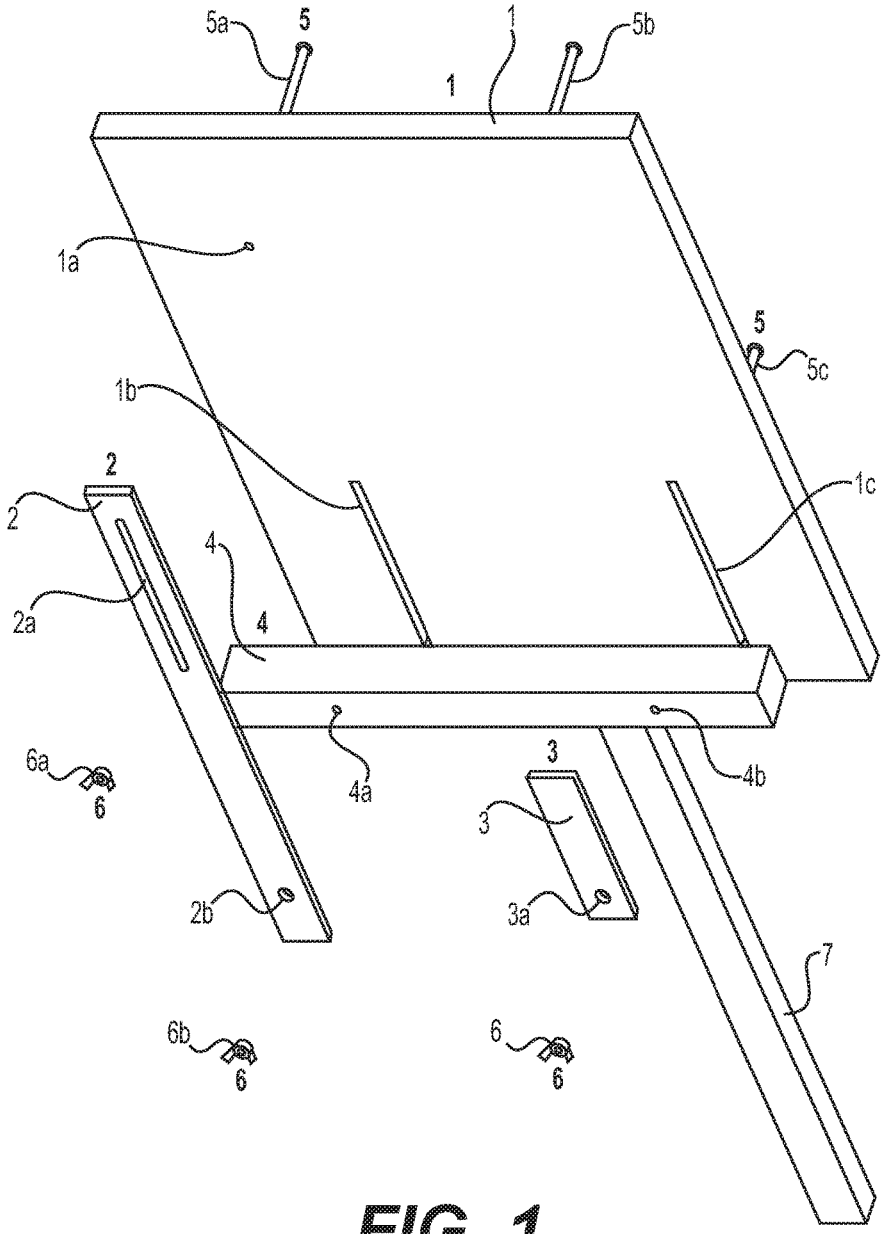
FIG. 1 shows an exploded perspective view of one example of a stringed musical instrument positioning apparatus according to various embodiments of the present invention.
Figure 2:
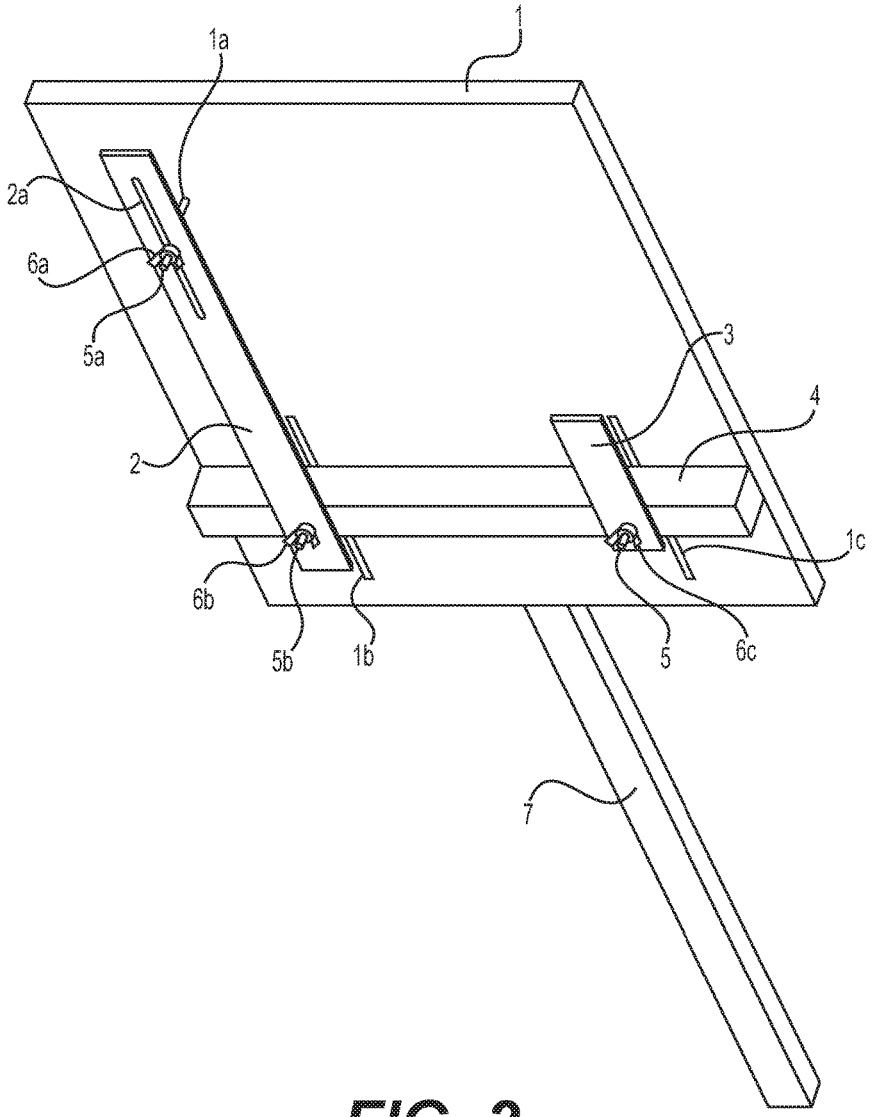
FIG. 2 depicts an angled front perspective view of one example of a stringed musical instrument positioning apparatus according to various embodiments of the present invention.
Figure 3:
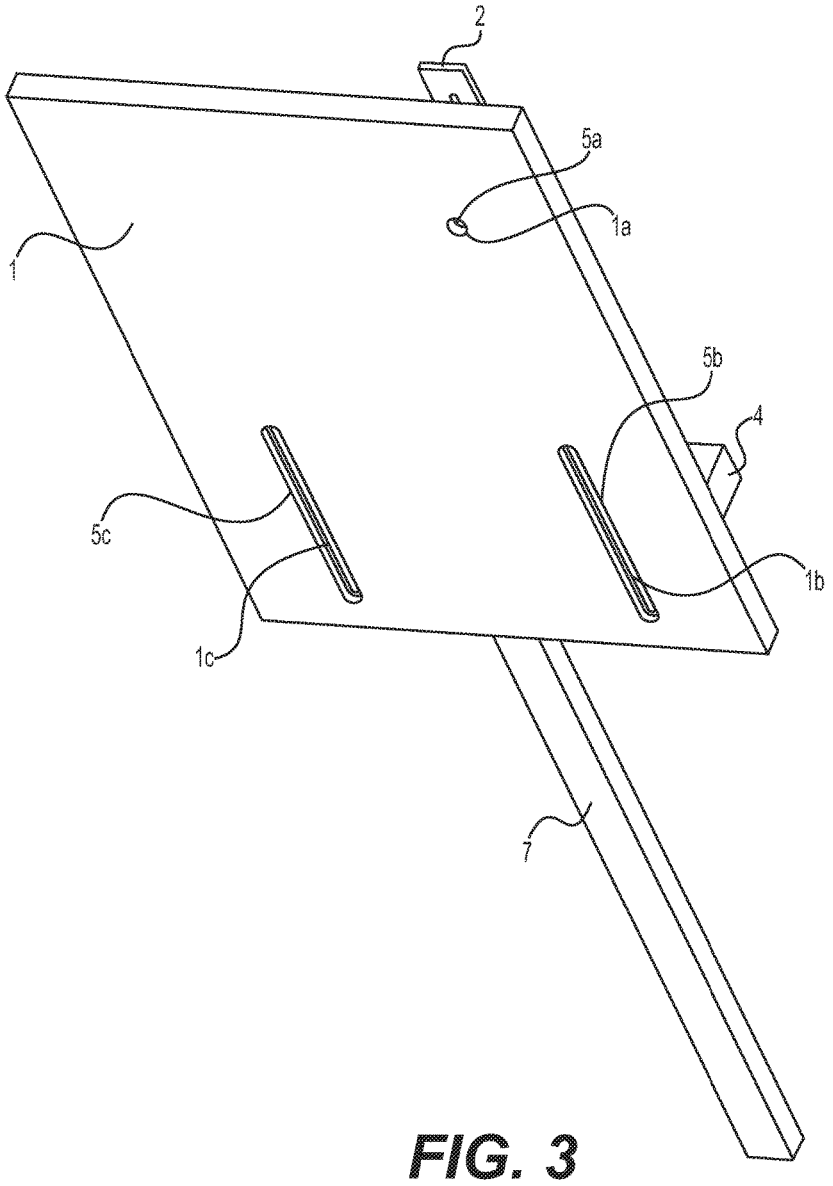
FIG. 3 depicts an angled rear perspective view of one example of a stringed musical instrument positioning apparatus according to various embodiments of the present invention.

The present invention will now be described by referencing the appended figures representing preferred embodiments. FIG. 1 depicts and exploded perspective view of the elements that may comprise a stringed musical instrument positioning apparatus (the "apparatus") according to various embodiments of the present invention. In preferred embodiments, each of the elements of the device is configured to accept fastener bolts 5*a*, 5*b*, and 5*c*, which are configured to accept threaded fastener nuts 6*a*, 6*b*, and 6*c*, respectively.

Fastener bolt 5*a* is fed through hole 1*a* in the rear plate 1 and through adjustment slot 2*a* of the primary stabilizer bar, and is secured with fastener nut 6*a*. Fastener bolt 5*b* is fed through adjustment slot 1*b* in rear plate 1, hole 4*a* of elevator platform 4, and hole 2*b* of primary stabilizer bar 2, and is secured with fastener nut 6*b*. Fastener bolt 5*c* is fed through adjustment slot 1*c* in rear plate 1, hole 4*b* of elevator platform 4, and hole 3*a* of secondary stabilizer bar 3, and is secured with fastener nut 6*c*. Adjustment slots 1*b*, 1*c*, and 2*a* on rear plate 1 and primary stabilizer bar 2 allow the configured elevator platform 4, primary stabilizer bar 2, and secondary stabilizer bar 3 to be slid to a desired height before being fixed in position by tightening of securing nuts 6*a*-6*c* so as to accommodate various sizes of stringed musical instruments and player comfort.

After the apparatus has been acceptably adjusted to fit to the stringed musical instrument, fastener nuts 6*a*-6*c* are tightened on fastener bolts 5*a*-5*c* to secure the stringed musical instrument. The apparatus is supported by a leg 7, which may include parts with a slots, bolts and nuts to form a telescoping leg to enable adjustment of the length of the leg 7.

Figure 4:
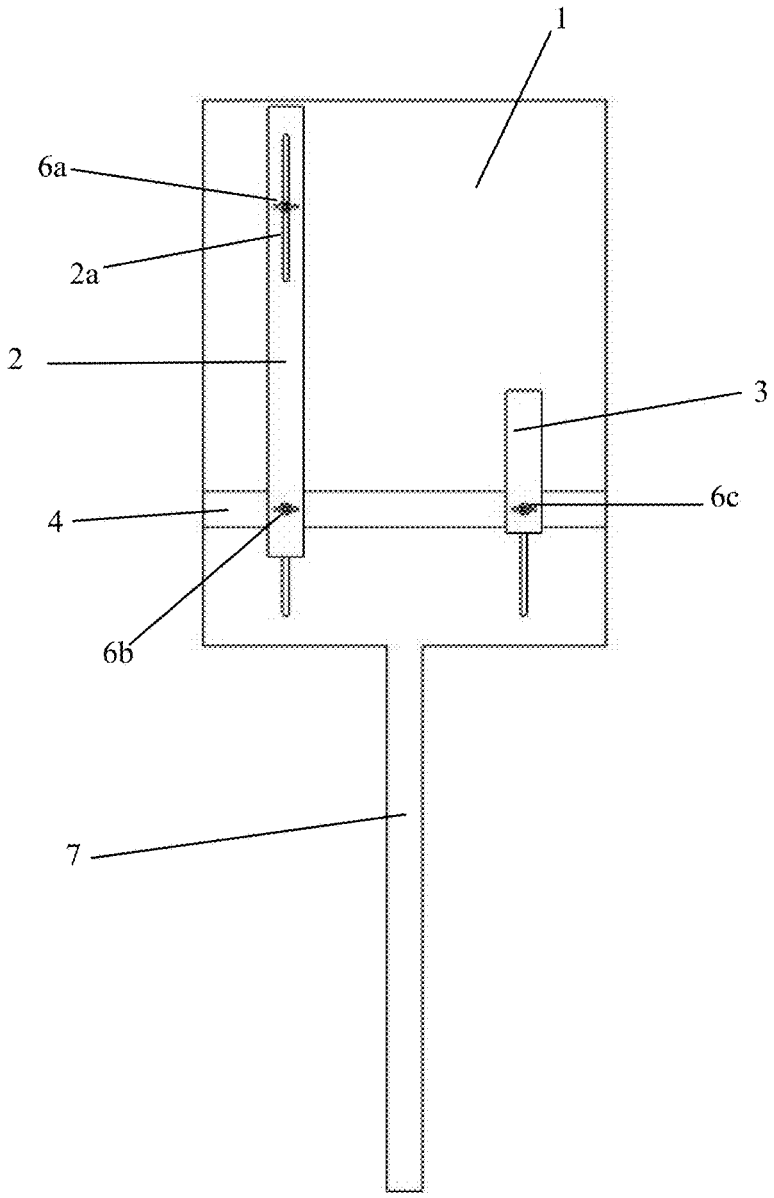
FIG. 4 illustrates a front perspective view of one example of a stringed musical instrument positioning apparatus according to various embodiments of the present invention.
Figure 5:
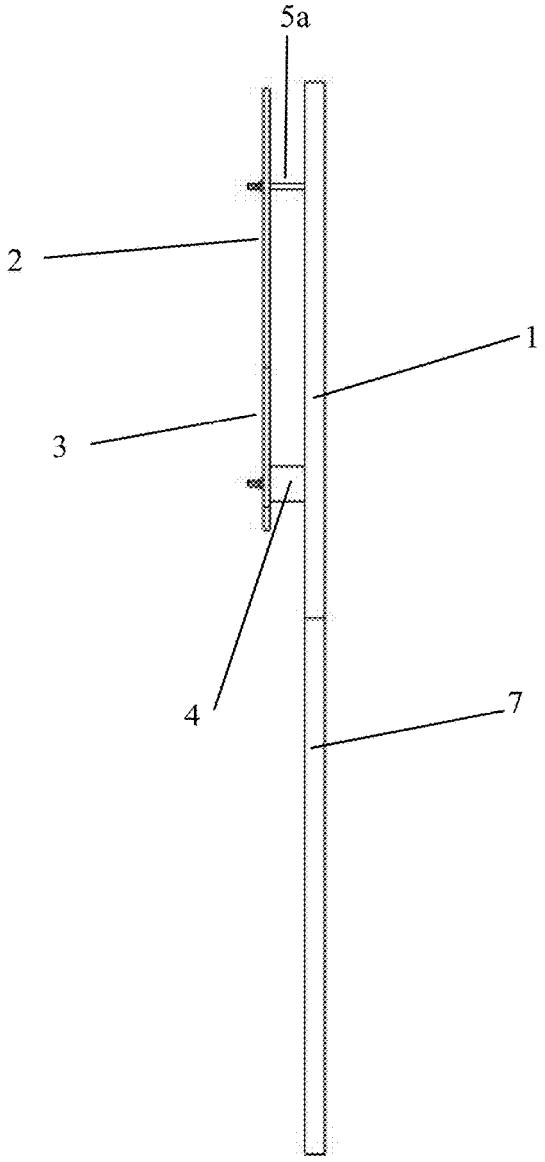
FIG. 5 depicts a side perspective view of one example of a stringed musical instrument positioning apparatus according to various embodiments of the present invention.
Figure 6:
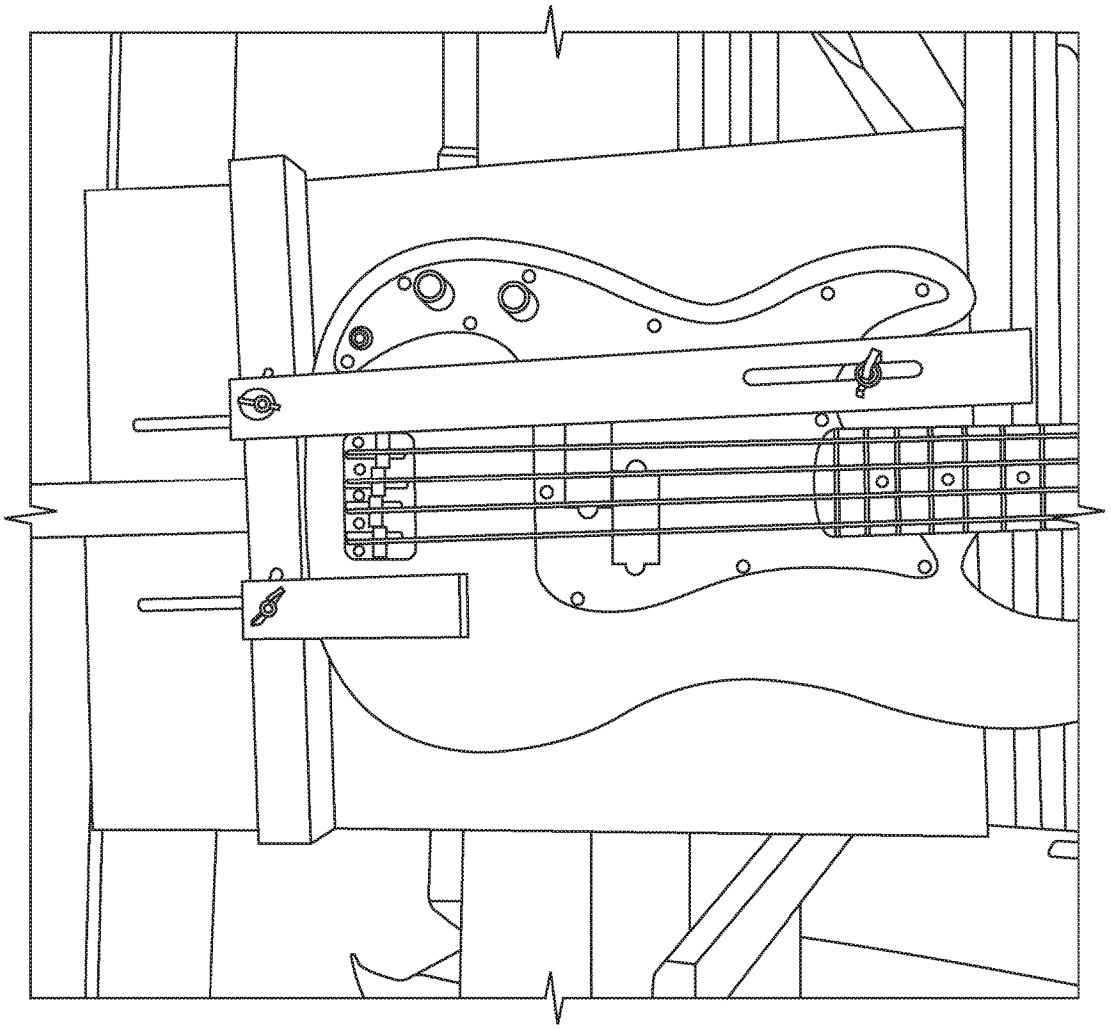
FIG. 6 shows a front perspective view of a stringed musical instrument secured in one example of a stringed musical instrument positioning apparatus according to various embodiments of the present invention.
Figure 7:
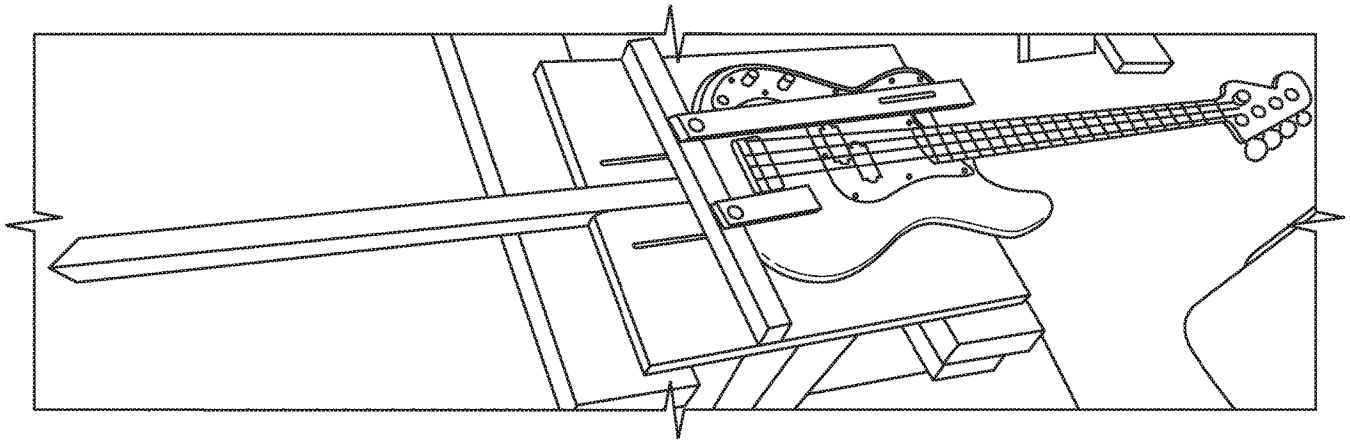
FIG. 7 presents a front perspective view of a stringed musical instrument in process of being secured in one example of a stringed musical instrument positioning apparatus according to various embodiments of the present invention.
Figure 8:
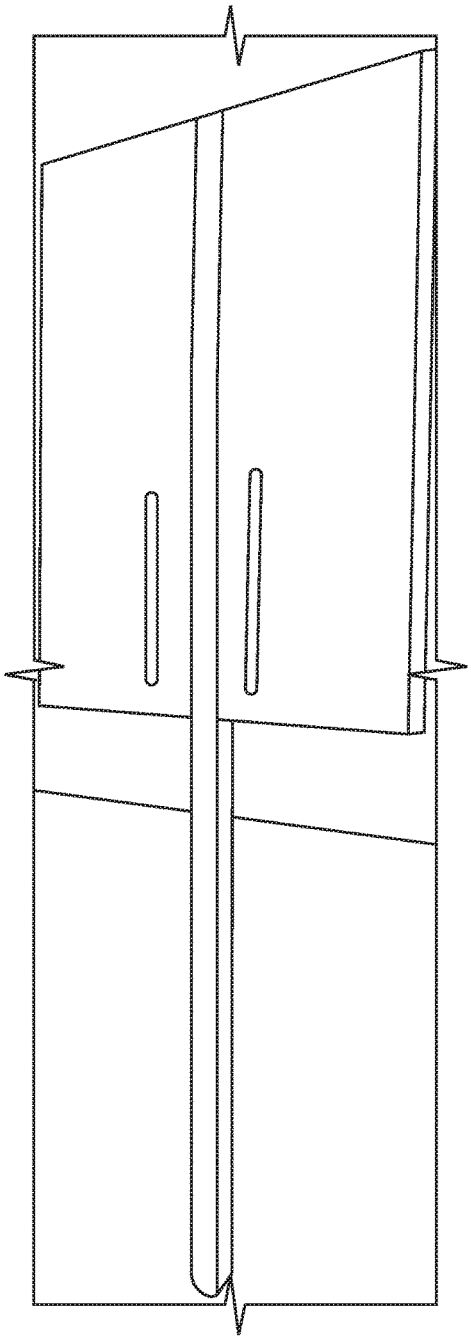
FIG. 8 shows a rear perspective view of one example of a stringed musical instrument positioning apparatus according to various embodiments of the present invention.
Figure 9:
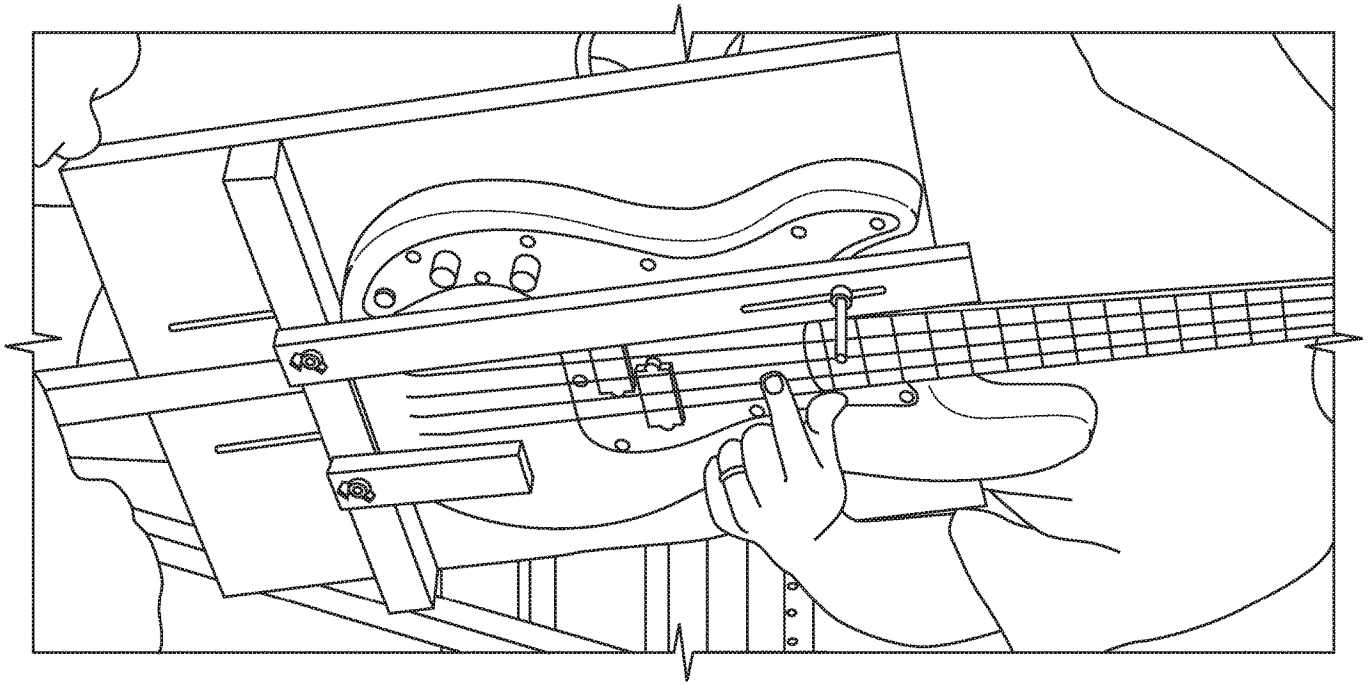
FIG. 9 presents a front perspective view of a stringed musical instrument being played while secured in one example of a stringed musical instrument positioning apparatus according to various embodiments of the present invention.
Figure 10:
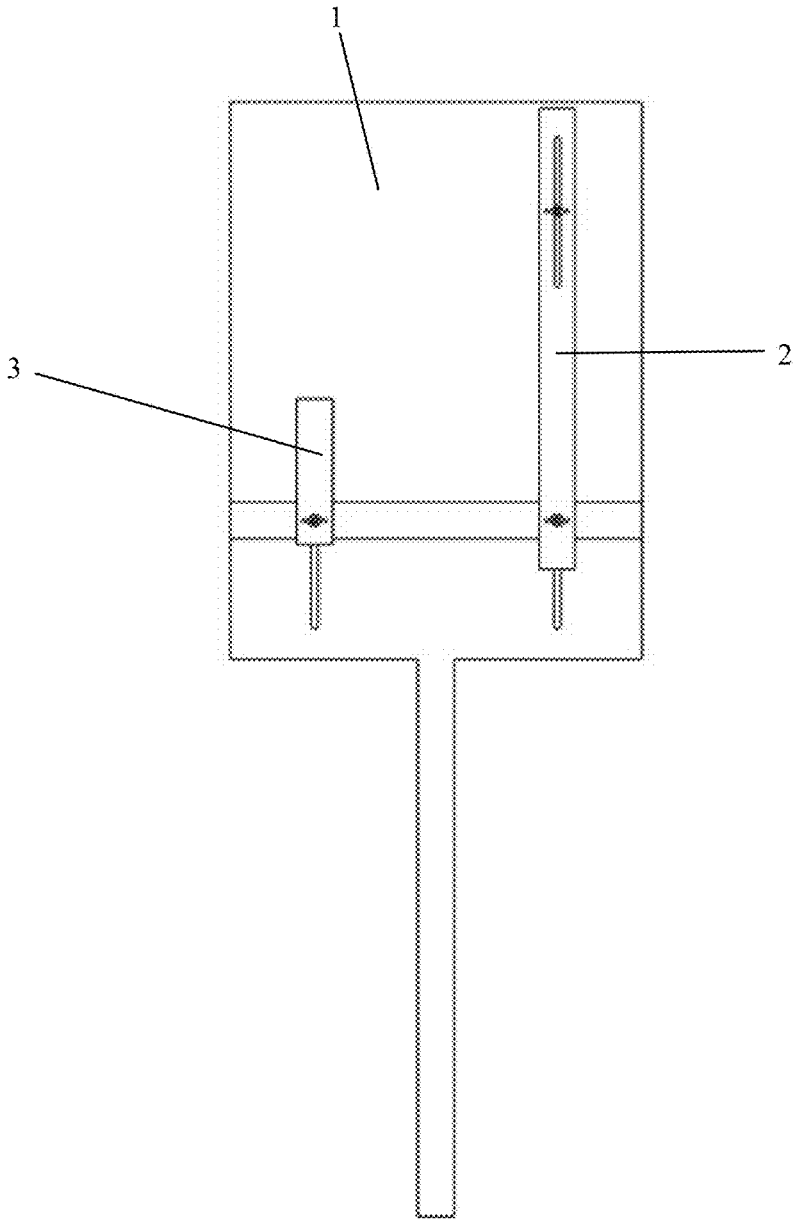
FIG. 10 illustrates a front perspective view of one example of a stringed musical instrument positioning apparatus configured to a right dominant-hand musician

The apparatus is designed to accommodate right-hand dominant musicians and left-hand dominant musicians. Configuring the apparatus for a particular dominant-handed musician is done by attaching rear plate 1, primary stabilizer bar 2, and secondary stabilizer bar 3 to either side of elevator platform 4. For example, FIG. 4 shows a configuration for a left dominant-hand musician, and FIG. 10 shows a configuration for a right dominant-hand musician. While the apparatus can be designed to accommodate both right-hand dominant and left-hand dominant players, the elements necessary for one or the other can be omitted so that each apparatus can be manufactured exclusively for either right-hand dominant or left-hand dominant implementations.

The materials which the present embodiment of the apparatus components, excluding fastener bolts 5 and fastener nuts 6, can be comprised of wood, and fastener bolts 5 and fastener nuts 6 can be comprised of steel. However, manufacture of the apparatus is not limited to these materials. Plastics, metal alloys, aluminum, and other materials or combinations of materials, including but not limited to components made from steel or aluminum and coated with rubber or foam, may comprise some or all of the elements of the stringed musical instrument positioning apparatuses and devices in various embodiments of the present invention.

While the shape of the present embodiment of the apparatus as shown is generally rectangular, the apparatus may be designed in such a way as to resemble other shapes, including but not limited to shapes that conform with the shapes of known stringed musical instruments, along with shapes not resembling musical instruments.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. An apparatus to be connected to a stringed instrument for positioning the stringed instrument to an upright playing position, the apparatus comprising:

a rear plate, to be positioned behind the instrument;

a first stabilizer bar connected to the rear plate via a first fastener and to be positioned in front of the instrument;

a second stabilizer bar connected to the rear plate via a second fastener and to be positioned in front of the instrument;

an elevator platform connected to the rear plate and the first and second stabilizer bars via the first and second fasteners, respectively and to be positioned below the instrument and adjacently between the rear plate and the first and second stabilizer bars; and a leg connected to the rear plate, wherein the rear plate, first stabilizer bar, second stabilizer bar, and elevator platform grip the instrument such that the rear plate, first stabilizer bar, second stabilizer bar, elevator platform, and instrument can together be held upright on the leg.

2. The apparatus according to claim 1, wherein:

the rear plate includes a first adjustment slot, and a second adjustment slot;

the elevator plate is connected to the rear plate via the first fastener through the first adjustment slot and the second fastener through the second adjustment slot;

the first stabilizer bar includes an adjustment slot and is connected to the rear plate via a third fastener through the adjustment slot in the first stabilizer bar; and the elevator plate, the first stabilizer bar, and the second stabilizer bar are together movable relative to the rear plate via the first and second adjustment slots in the rear plate and the adjustment slot in the first stabilizer bar.

3. The apparatus according to claim 1, wherein:

the first and second stabilizer bars extend in substantially parallel directions with respect to each other when holding the instrument.

4. The apparatus according to claim 1, wherein:

the first stabilizer bar is longer than the second stabilizer bar.

5. The apparatus according to claim 1, wherein:

the first and second stabilizer bars are positioned to each extend in a substantially perpendicular direction with respect to the elevator platform when holding the instrument.

6. The apparatus according to claim 5, wherein:

the elevator platform extends horizontally beyond both the first and second stabilizer bars when holding the instrument upright on the leg.

7. The apparatus according to claim 1, wherein:

the first and second stabilizer bars, the elevator platform, and the rear plate grip the main body portion of the instrument so that an extending arm portion of the instrument can be held by an individual playing the instrument.

8. An apparatus to be connected to a stringed instrument for positioning the stringed instrument to an upright playing position, the apparatus comprising:

a rear plate, to be positioned behind the instrument;

a first stabilizer bar connected to the rear plate via and to be positioned in front of the instrument;

a second stabilizer bar connected to the rear plate and to be positioned in front of the instrument;

an elevator platform connected to the rear plate and to be positioned below the instrument; and a leg connected to the rear plate, wherein the rear plate, first stabilizer bar, second stabilizer bar, and elevator platform grip the instrument such that the rear plate, first stabilizer bar, second stabilizer bar, elevator platform, and instrument can together be held upright on the leg, wherein:

the rear plate includes a first adjustment slot, and a second adjustment slot;

the elevator plate is connected to the rear plate via a first fastener through the first adjustment slot and a second fastener through the second adjustment slot;

the first stabilizer bar includes an adjustment slot and is connected to the rear plate via a third fastener through the adjustment slot in the first stabilizer bar; and the elevator plate, the first stabilizer bar, and the second stabilizer bar are together movable relative to the rear plate via the first and second adjustment slots in the rear plate and the adjustment slot in the first stabilizer bar.

* * * * *